US005601042A

United States Patent [19]

Goto

[11] Patent Number: 5,601,042

[45] Date of Patent: Feb. 11, 1997

[54] SAFETY DEVICE FOR ZIGZAG SEWING MACHINE AND ZIGZAG SEWING MACHINE HAVING THE SAME

[75] Inventor: Seiji Goto, Tokyo, Japan

[73] Assignee: Juki Corporation, Tokyo, Japan

[21] Appl. No.: 524,489

[22] Filed: Sep. 6, 1995

[30] Foreign Application Priority Data

Sep. 6, 1994 [JP] Japan ..... 6-212790

[51] Int. Cl.[6] ..... D05B 3/02; D05B 19/14

[52] U.S. Cl. ..... 112/462; 112/448

[58] Field of Search ..... 112/65, 66, 78, 112/98, 470.01, 470.04, 443, 446, 448, 449, 459, 462, 464, 475.25

[56] References Cited

U.S. PATENT DOCUMENTS

| | | | |
|---|---|---|---|
| 2,888,893 | 6/1959 | Gegauf | 112/448 X |
| 3,060,875 | 10/1962 | Iida | 112/448 |
| 3,215,104 | 11/1965 | Bono | 112/448 |
| 4,063,525 | 12/1977 | Sasaki | 112/462 X |
| 4,368,681 | 1/1983 | Hanyu et al. | 112/462 |

*Primary Examiner*—Ismael Izaguirre
*Attorney, Agent, or Firm*—Morgan, Lewis and Bockius LLP

[57] ABSTRACT

A safety device for a zigzag sewing machine comprising a swing width adjusting mechanism, a basic line setting mechanism, and a pattern setting mechanism, is made up of: pattern change inhibiting mechanism which, where a basic line other than the middle basic line has been set by the basic line setting mechanism, prevents a regular pattern sewing mode set by the pattern setting mechanism from being changed to an inverse pattern sewing mode; and basic line change inhibiting mechanism which, where an inverse pattern has been set by the pattern setting mechanism, prevents the middle basic line set by the basic line setting mechanism from being changed to other than the middle basic line.

5 Claims, 12 Drawing Sheets

15
16
6a
7a
6
5
4

FIG. 11(a)
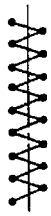
FIG. 11(b)
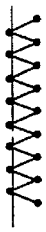
FIG. 11(c)
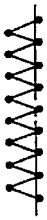
FIG. 12(a)
FIG. 12(b)
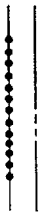
FIG. 12(c)
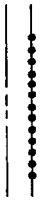

SAFETY DEVICE FOR ZIGZAG SEWING MACHINE AND ZIGZAG SEWING MACHINE HAVING THE SAME

BACKGROUND OF THE INVENTION

1. Field of the Invention

This invention relates to a zigzag sewing machine adapted to form zigzag seams, and more particularly to a safety device in a zigzag sewing machine which prevents various function setting operations from being performed erroneously.

2. Description of the Related Art

In order to form zigzag seams as shown in FIGS. 6(*a*) to 6(*d*), a zigzag sewing machine is generally employed which has a so-called "needle swinging mechanism" which swings a sewing needle across the work feed direction.

A zigzag sewing machine of this type has a needle swinging cam for a given seam to be formed. That is, it is provided, as a dedicated sewing machine for forming the seam only, in a sewing factory or the like. For instance, in the case where a so-called "two-dot zigzag seam" as shown in FIG. 6(*a*) is to be formed, a sewing machine having a needle swinging cam C1 as shown in FIG. 7(*a*) is provided; and in the case where a so-called "four-dot zigzag seam" as shown in FIG. 6(*b*) is to be formed, a sewing machine having a needle swinging cam C2 as shown in FIG. 7(*b*) is provided; and in the case where a so-called "scallop seam" as shown in FIG. 6(*c*) is to be formed, a sewing machine having a needle swinging cam C3 as shown in FIG. 7(*c*) is provided.

Those sewing machines are not suitable for the recent apparel industry in which a variety of items are formed each by only a small number.

Hence, it has been proposed to realize a general purpose zigzag sewing machine which has different needle swinging cams, which are replaceable with one another, to form different seams.

In this connection, in order to allow the general purpose zigzag sewing machine to form the different seams which are formed by the dedicated sewing machines, the general purpose zigzag sewing machine should have all the fundamental functions of those dedicated sewing machines.

The fundamental functions of a conventional zigzag sewing machine are a function of adjusting the swing width of the needle swinging mechanism (hereinafter referred to as "a swing width adjusting function", when applicable), a function of changing a seam-forming-position with the position of a needle swing range and a needle swing width set to zero (0) (hereinafter referred to as "a basic line changing function", when applicable), and a function of forming an inverse seam which is axially symmetrical with a normal seam which is formed by an ordinary needle swinging operation (hereinafter referred to as "a seam inverting function", when applicable). Of those functions, the swing width adjusting function is given to all of the dedicated sewing machines; however, the remaining functions, namely, the basic line changing function and the seam inverting function are alternatively given to the dedicated sewing machines according to the kinds of seams they form.

In other words, in the case of the sewing machines which form seams which are each substantially symmetrical with respect to an axis as shown in FIGS. 6(*a*) and 6(*b*), it is unnecessary to give the seam inverting function to them, but it is necessary to give the basic line changing function. On the other hand, in the case of the sewing machine which forms a so-called "scallop seam" as shown FIGS. 6(*c*) and 6(*d*), the sewing machine must have the seam inverting function, but not the basic line changing function.

Hence, the conventional zigzag sewing machines have only the swing width adjusting function and the basic line changing function, or only the swing width adjusting function and the seam inverting function. That is, there is no conventional zigzag sewing machine which has the three functions.

However, in order to allow a zigzag sewing machine to replace the needle swinging cam to form all the seams shown in FIGS. 6(*a*) to 6(*d*), it is essential that the sewing machine has all of the three functions, namely, the swing width adjusting function, the basic line changing line, and the seam inverting function. For this purpose, a zigzag sewing machine as shown in FIGS. 8 and 9 has been proposed in the art.

FIG. 8 shows a conventional zigzag sewing machine M. In the sewing machine M, an electric motor (not shown) is driven to rotate a spindle 2 held by a sewing machine arm Ma and an oscillating shaft (not shown) supported by a sewing machine bed, whereby a sewing needle N is moved up and down, and a sewing machine shuttle is turned. On the other hand, as the sewing machine oscillating shaft turns, a needle swinging cam 4 is turned together with a cam shaft 3, so that a coupling rod 5 with a roller 5*a* engaged with a cam groove 4*a* formed in the needle swinging cam 4 moves a needle swinging link 6 up and down which is pivotally coupled to the coupling rod 5.

The needle swinging link 6 is swingably coupled through a coupling shaft 6*a* to a swing width adjusting link 7 which is so supported that it is swingable about a swing fulcrum shaft 7*a*. Therefore, the vertical movement of the needle swinging link 6 includes a horizontal component, which is transmitted through a coupling 8 to a swinging rod (or horizontal moving member) 9. One end of the swinging rod 9 is fixedly secured to a needle bar supporting stand 10 which supports a needle bar NL in such a manner that the needle bar NL is vertically movable. As the needle bar supporting stand 10 moves horizontally together with the swinging rod 9, the needle bar NL and accordingly a sewing needle N is swung across the work feed direction.

As was described above, the sewing needle N is moved up and down by the rotation of the sewing machine spindle 2, and swung by the rotation of the sewing machine oscillating shaft, thus forming a zigzag seam as shown in FIGS. 6(*a*) to 6(*d*) which turns right and left alternately with respect to the work feed direction. The above-described components 6 through 10 form a needle swinging mechanism A, and the components 4 and 5 and the oscillation shaft (not shown) form driving means.

The above-described needled swinging mechanism A is coupled to a mechanism as shown in FIG. 9, so that the above-described swing width adjusting function, basic line changing function and seam inverting function be realized.

In FIG. 9, reference numeral 11 designates a basic line changing shaft which is swingably supported on a mounting stand Mc which is fixedly secured inside the arm Ma of the sewing machine. A basic line changing knob 12 is fixedly mounted on the outer end portion of the basic line changing shaft 11, and a basic line changing board 13 is fixedly mounted on the inner end portion of the basic line changing shaft 11. Further in FIG. 9, reference numeral 14 designates a swing width adjusting shaft which is fixedly secured to the basic line changing board 13. One end portion of the shaft 14 is inserted into elongated holes Ma1 and Mc1 which are formed in the arm Ma and the mounting stand Mc, respectively, thus being protruded outside the arm Ma. A swing width adjusting knob 15 is fixedly mounted on the outer end portion of the shaft 14. The above-described elongated holes Ma1 and Mc1 are formed arcuate around the basic line changing shaft 11.

Further in FIG. 9, reference numeral 16 designates a swing width adjusting arm. One end of the arm 16 is fixedly connected to the aforementioned swing width adjusting shaft 14, and the other end is connected to the swing fulcrum shaft 7*a* of the swing width changing link 7.

In the zigzag sewing machine thus organized, the swing width of the sewing needle N is adjusted by turning the swing width adjusting knob 15. That is, as the swing width adjusting knob 15 is turned, the swing width adjusting shaft 14 is turned, so that the swing width adjusting arm 16 and the swing fulcrum shaft 7*a* are angularly moved about the shaft 14.

Let us consider the case where the swing fulcrum shaft 7*a* is in a region α above a horizontal border line Lh passing through the center of the swing width adjusting shaft 4 (hereinafter referred to as "a regular region α", when applicable). In this case, as the shaft 7*a* is moved upwardly, the horizontal swing component of the swing width changing link 7 is increased, and the swing width of the sewing needle N is also increased (see FIGS. 10(*b*) and 10(*c*)). In contract, as the swing fulcrum shaft 7*a* located in the regular region α is moved downwardly towards the horizontal border line Lh, the horizontal swing component of the swing width changing link 7 is decreased, and the swing width of the sewing needle is also decreased. On the other hand, in the case where the swing fulcrum shaft 7*a* is on the horizontal border line Lh, the horizontal swing component of the swing width changing link 7 is substantially zero as indicated in FIG. 10(*a*), and the needle swinging operation is stopped. In this case, a straight seam is formed.

Let consider the case where the swing fulcrum shaft 7*a* is in a region β below the horizontal border line Lh as shown in FIG. 10(*d*) which is opposite to the region α (hereinafter referred to as "an inverse region β", when applicable). In this case, as the swing fulcrum shaft 7*a* is moved downwardly, the horizontal swing component of the needle swinging link 6 is increased, and the swing width of the sewing needle NL is also increased. Let us consider two symmetrical positions above and below the border line Lh. The horizontal components of the swing motions at those two positions are symmetrical, so that the seams formed by the sewing motions are axially symmetrical as shown in FIG. 6(*c*) or 6(*d*). That is, if it is assumed that FIG. 6(*c*) shows a regular seam which is formed with the swing fulcrum shaft 7*a* set in the regular region α, then FIG. 6(*d*) shows the seam which is inverse in pattern to the regular seam, being formed with the swing fulcrum shaft 7*a* set in the inverse region β.

The above-described swing width adjusting shaft 14, swing width adjusting knob 15 and swing width adjusting arm 16 form a swing width adjusting mechanism and a pattern changing mechanism.

In the above-described needle swinging operation, the basic line can be changed by turning the basic line changing knob 12.

As the knob 12 is turned, the basic line changing board 13 is turned together with the basic line changing shaft 11, so that the swing width adjusting shaft 14 is moved along the elongated hole Ma1. As a result, the swing width adjusting arm 16 and the swing fulcrum shaft 7*a* together with the swing width adjusting shaft 14 are swung about the basic line changing shaft 11, and the coupling shaft 6*a* and the needle swinging link 6 are moved right or left through the swing width changing link 7. This movement is transferred through a coupling 8 to a swing rod 9, so that the sewing needle N is moved right or left. Thus, the basic line has been changed.

That is, as the basic line changing knob 12 is operated, the swing range of the sewing needle is shifted left or right, as a whole, as shown in FIG. 11(*b*) or 11(*c*). In the case where the swing width of the sewing needle N is set to zero (0), as shown in FIG. 12(*b*) or 12(*c*) the sewing needle N is positioned at the left or right end of the swing range, so that a straight seam is formed there. FIGS. 11(*a*) and 12(*a*) show seams which are formed with the basic line set at the middle (center); FIGS. 11(*b*) and 12(*b*) show seams which are formed with the basic line set on the left side; and FIGS. 11(*c*) and 12(*c*) show seams which are formed with the basic line set on the right side.

Thus, the above-described basic line changing shaft 11, basic line changing knob 12, and basic line changing board 13 form a basic line setting mechanism.

As is apparent from the above description, the conventional zigzag sewing machine has the swing width adjusting function, the inverse seam forming function, and the basic line changing function, thus being able to form a variety of seams.

However, the above-described conventional zigzag sewing machine is disadvantageous in the following points:

With the sewing machine, under the condition that a basic line other than the middle basic line is set, an inverse pattern sewing mode may be set. If, under this condition, the sewing operation is carried out, the sewing needle N may interfere with the throat plate, or the resultant seam may be unacceptable.

In the case where the middle basic line is selected, the swing width adjusting shaft 14 is positioned on the border line Lh as shown in FIG. 13(*a*). Hence, even if the swing fulcrum shaft 7*a* is shifted from a regular pattern setting position to an inverse pattern setting position by turning the swing width adjusting arm 16, the position of the shaft 7*a* is maintained unchanged in a horizontal direction as shown in FIG. 13(*a*) (being on the line P1), and therefore the swing range of the sewing needle N is not changed as shown in FIGS. 13(*b*) and 13(*c*). That is, the sewing needle N is allowed to swing while being regulated by a needle drop hole NB1 formed in the throat plate NB.

On the other hand, the left or right basic line may be selected as shown in FIG. 14(*a*) or 15(*a*). In this case, as indicated by reference characters P1 and P2 in FIGS. 14(*a*) and 15(*a*) the position of the swing fulcrum shaft 7*a* in a horizontal direction in the case where a regular pattern sewing mode is set (as indicated by the solid lines) is different from that of the shaft 7*a* in the horizontal direction in the case where an inverse pattern sewing mode is set (as indicated by the one-dot chain lines). Hence, in the case where the left basic line or the right basis line is set, the swing ranges of the needle swinging link and the sewing needle are shifted, as a result of which the sewing needle interferes with the throat plate. That is, as shown in FIG. 16, in the case where the left basic line is set for an inverse pattern, the needle N drops on the left side of the needle drop hole NB1 of the throat plate NB, thus interfering with the latter NB. As a result, the needle may be broken, or the throat plate NB may be damaged.

Furthermore, if, in the case where the right or left basic line is set, the drop position of the sewing needle N is greatly shifted from that of the needle in the case where the middle basic line is set, then sometimes the sewing machine shutter is unable to catch the upper thread passed through the sewing needle, so that tying the upper and lower threads together may be unsatisfactory.

This difficulty is due to the following fact: In the case where a basic line other than the middle basic line is selected, it is unnecessary to set the inverse pattern sewing mode, and therefore the shuttle and the needle drop hole NB1 are designed for the case only in which the middle basic line is set. Hence, the above-described difficulty may be eliminated by designing the shuttle and the needle drop hole with the case taken into account in which a basic line other than the middle basic line is set.

However, in this case, it is necessary to make the needle drop hole relatively larger, which gives rise to another problem that, during sewing, the large needle drop hole makes the work unstable, or it may catch the work. In addition, it is necessary to provide a relatively large shuttle. It is rather difficult to accommodate the large shuttle below the throat plate. In addition, it is necessary to design a new shuttle turning mechanism, which incurs great expense. Thus, to do so is considerably difficult.

As is apparent from the above description, the conventional zigzag sewing machine is not free from the difficulty that the right or left basic line and the inverse pattern sewing mode are set in error, so that the sewing needle is broken or the resultant seam is unsatisfactory. This is one of the factors which greatly impede the realization of a general purpose zigzag sewing machine.

SUMMARY OF THE INVENTION

In view of the foregoing, an object of the invention is to provide a safety device for a zigzag sewing machine which prevents the erroneous operation which may result in the breakage of the sewing needle and in the formation of unsatisfactory seams.

The foregoing object of the invention has been achieved by the provision of a safety device for a zigzag sewing machine comprising:

- a needle swinging mechanism for swinging a sewing needle right and left;
- a swing width adjusting mechanism for adjusting the swing width of the sewing needle which is swung by the needle swinging mechanism;
- a basic line setting mechanism for setting a middle basic line which is located at the middle of the swing width of the sewing needle, a right basic line located on the right side of the middle basic line, or a left basic line located on the left side of the middle basic line;
- a pattern setting mechanism for selecting a regular pattern sewing mode or an inverse pattern sewing mode, which device, according to the invention, comprises:

- pattern change inhibiting means which, where a basic line other than the middle basic line has been set by the basic line setting mechanism, prevents a regular pattern sewing mode set by the pattern setting mechanism from being changed to an inverse pattern sewing mode; and
- basic line change inhibiting means which, where an inverse pattern sewing mode has been set by the pattern setting means, prevents the middle basic line set by the basic line setting mechanism from being changed to other than the middle basic line.

The safety device of the invention functions as follows: Where the middle basic line has been selected by the basic line setting mechanism, the regular pattern sewing mode or the inverse pattern sewing mode can be set by the pattern selecting mechanism. Where the regular pattern sewing mode has been set by the pattern setting mechanism, the middle basic line, the right basic line, or the left basic line can be set as the case may be. Those settings make it possible to form a variety of seams. On the other hand, in the case where, under the condition that the middle basic line and the inverse pattern sewing mode have been set, the operator tries to set a basic line other than the middle basic line in error, the erroneous setting operation is inhibited by the basic line change inhibiting means. That is, no sewing operation is carried out when a basic line other than the middle basic line and the inverse pattern sewing mode are selected. If, after the regular pattern sewing mode and a basic line other than the middle basic line being set, it is tried to set the inverse pattern sewing made in error, the erroneous setting operation is inhibited by the pattern change inhibiting means. That is, no sewing operation is performed when a basic line other than the middle basic line and the inverse pattern sewing made are selected. Thus, the difficulties are eliminated that the erroneous setting operation results in the interference of the sewing needle with the throat plate, or the formation of an unsatisfactory seam.

BRIEF DESCRIPTION OF THE DRAWINGS

FIG. 2(*b*) is showing the case where a regular pattern sewing mode and a basic line other than the middle basic line are set; FIG. 2(*c*) is showing the case where the middle basic line and an inverse pattern sewing mode are set, respectively;

FIG. 3(*b*) is a diagram for an operation showing the case where the middle basic line has been set and the inverse pattern mode has been set;

FIG. 4(*b*) is a diagram showing the case where a reverse pattern sewing mode is selected under the condition that the a basic line other than the middle basic line has been set;

FIG. 5(*b*) is a sectional view showing the case where a regular pattern sewing mode and a basic line other than the middle basic line are set; and FIG. 5(*c*) is also a sectional view showing the case where the middle basic line and an inverse pattern sewing mode are selected;

FIG. 11(*a*) is a plan view showing a zigzag seam formed with the middle basic line set; FIG. 11(*b*) is a plan view showing a zigzag seam formed with the left basic line set; and FIG. 11(*c*) is also a plan view showing a zigzag seam formed with the right basic line set;

FIG. 12(*a*) is a plan view showing a straight seam formed with the middle basic line set; FIG. 12(*b*) is a plan view showing a straight seam formed with the left basic line set; and FIG. 12(*c*) is also a plan view showing a straight seam formed with the right basic line set;

FIG. 13(*b*) is an explanatory side view for a description of the swinging of a needle swinging link with the regular pattern sewing mode set as shown in FIG. 13(*a*); and FIG. 13(*c*) is an explanatory side view for a description of the swinging of the needle swinging link with the inverse pattern sewing mode set as shown in FIG. 13(*a*);

FIG. 14(*b*) is an explanatory side view for a description of the swinging of the needle swinging link with the regular pattern sewing mode set as shown in FIG. 14(*a*); and FIG. 14(*c*) is an explanatory side view for a description of the swinging of the needle swinging link with the inverse pattern sewing mode set as shown in FIG. 14(*a*);

FIG. 15(*b*) is an explanatory side view for a description of the swinging of a needle swinging link with the regular pattern sewing mode set as shown in FIG. 15(*a*); and FIG. 15(*c*) is an explanatory side view for a description of the swinging of the needle swinging link with the inverse pattern sewing mode set as shown in FIG. 15(*a*)

DETAILED DESCRIPTION OF THE PREFERRED EMBODIMENTS

Figure 1A:
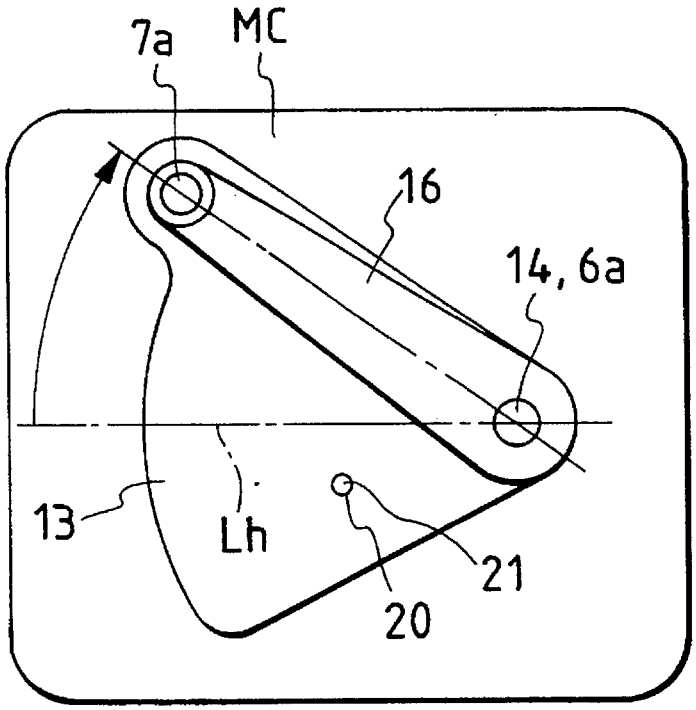
FIGS. 1(*a*) and 1(*b*) are a plan view and a side view, with parts cut away, respectively, showing the first embodiment.
Figure 1B:
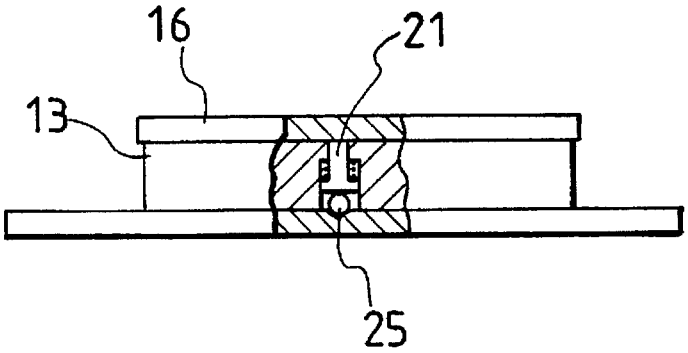

Preferred embodiments of the invention will be described with reference to the accompanying drawings.

An example of a safety device for a zigzag sewing machine, which constitutes a first embodiment, will be described with reference to FIGS. 1 through 4, in which parts corresponding functionally to those already described with reference to the conventional zigzag sewing machine are therefore designated by the same reference numerals or characters.

The safety device is provided for a zigzag sewing machine which has the same needle swinging mechanism A, swing width adjusting mechanism, pattern setting mechanism, basic line setting mechanism. The device is designed as follows:

In FIGS. 1 through 4, reference numeral 21 designates an abutting pin (or abutting member) inserted in a through-hole 20 formed in the basic line changing board 13 which is a part of the basic line setting mechanism. The abutting pin 21 is so positioned that, when the swing width is set to zero (0), it meets the side edge of the swing width adjusting arm 16, and when the inverse pattern is set, it is covered by the arm 16.

Further in FIGS. 1 through 4, reference numeral 22 designates a locking ball (or locking member) set in the through-hole 20 in such a manner that it is located between the abutting pin 21 and the mounting stand Mc. Reference numeral 23 denotes a spring interposed between the spring receiver 21*a* of the abutting pin 21 and the shoulder of the through-hole 20. The spring 23 urges the abutting pin 21 towards the mounting stand Mc, so that the locking ball 22 is pushed against one side of the mounting stand Mc at all times.

Further in FIGS. 1 through 4,reference numeral 25 designates an engaging recess formed in the mounting stand Mc. More specifically, the recess 25 is so formed that it is engageable with the locking ball 22. When the locking ball 22 is engaged with the recess 25, the basic line changing board 13 is so positioned as to set the middle basic line; that is, the swing width adjusting shaft 14 is set on the horizontal line (or border line) Lh which passes through the coupling shaft 6*a*.

In the embodiment, the safety device is designed as described above. With the middle basic line set, the locking ball 22 is engaged with the engaging recess 25 of the mounting stand Mc by the elastic force of the spring, and the abutting pin 21 is completely sunk in the through-hole 20 of the basic line changing board 12 (see FIGS. 1(*b*) and 2(*a*)). Hence, the swing width adjusting arm 16 is freely swingable about the swing width adjusting shaft 14; that is, the swing fulcrum shaft 7*a* can be moved into the regular region α, and can be moved to the swing width zero position and into the inverse region β.

In other words, where the middle basic line is set so that an inverse pattern is formed which is completely axially symmetrical with a regular pattern, the swing width adjusting arm 16 can be freely swung with the swing width adjusting knob 15.

Figure 2A:
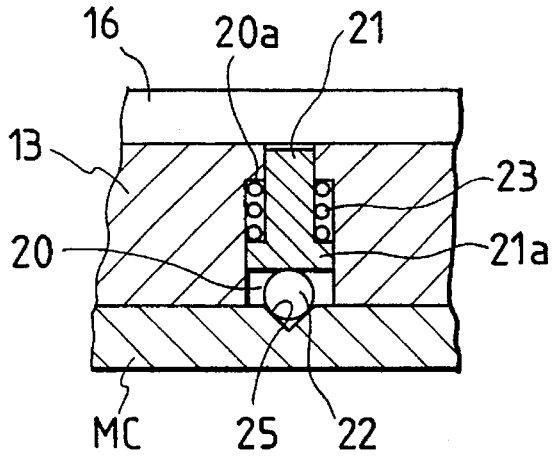
FIG. 2(*a*) is an enlarged sections view parts of the first embodiment showing the case where a middle basic line is set.
Figure 2B:
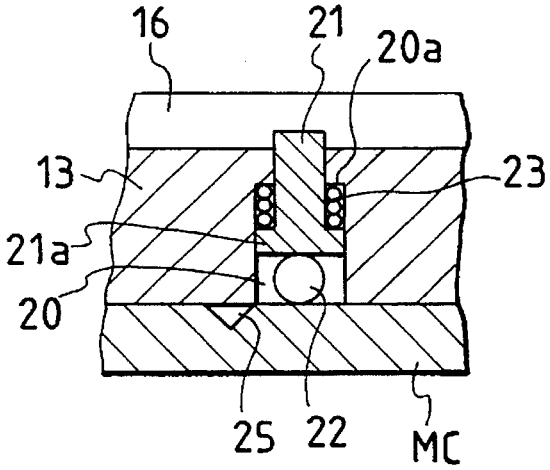
Figure 2C:
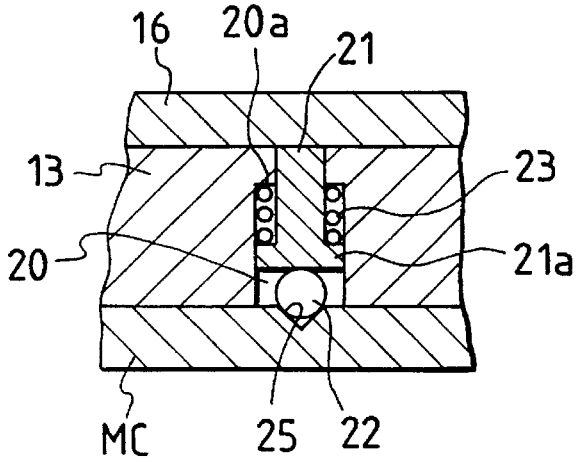

Under the condition that, with the middle basic line selected, the swing fulcrum shaft 7*a* is set in the regular region α, the basic line changing knob 12 may be turned to change the basic line. In this case, by turning the basic line changing knob 12, the basic line changing board 13 is turned together with the basic line changing shaft 11, so that the abutting pin 21 and the engaging ball 25, which are accommodated in the board 13, are turned. As a result, as shown in FIG. 2(*b*), the engaging ball 25 is disengaged from the engaging recess 25 of the mounting stand Mc, and placed on the inner surface of the mounting stand Mc, thus pushing the abutting pin 21. More specifically, the end portion of the abutting pin 21 is protruded from the through-hole 20. In this connection, the position where the abutting pin 21 protrudes in the above-described manner is so predetermined that the pin 21 is brought into contact with or located near the side surface of the swing width adjusting arm 16. Hence, the swing width adjusting arm 16, being abutted against the abutting pin 21, is prevented from moving into the inverse region. The above-described technique is equally applied to the case where the right or left basic line has been selected.

Figure 3A:
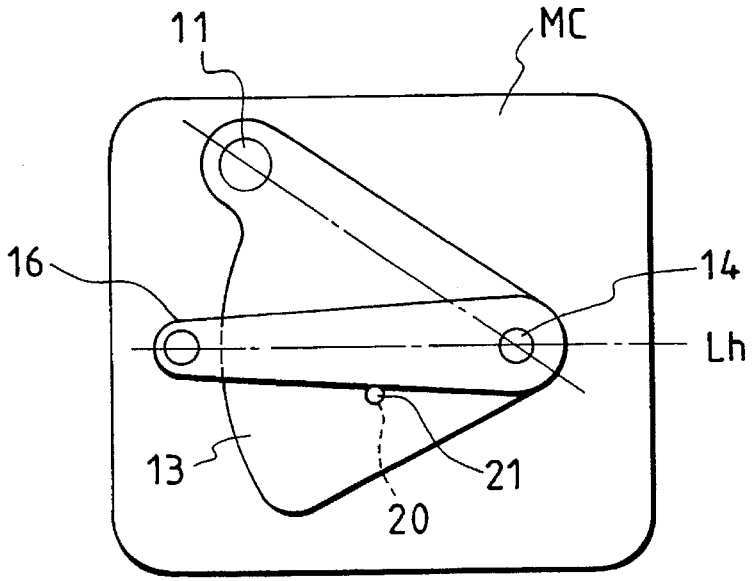
FIG. 3(*a*) is a diagram for an operation of the first embodiment showing the case where the swing width is set to zero (0) under the condition that the middle basic line has been set.
Figure 3B:
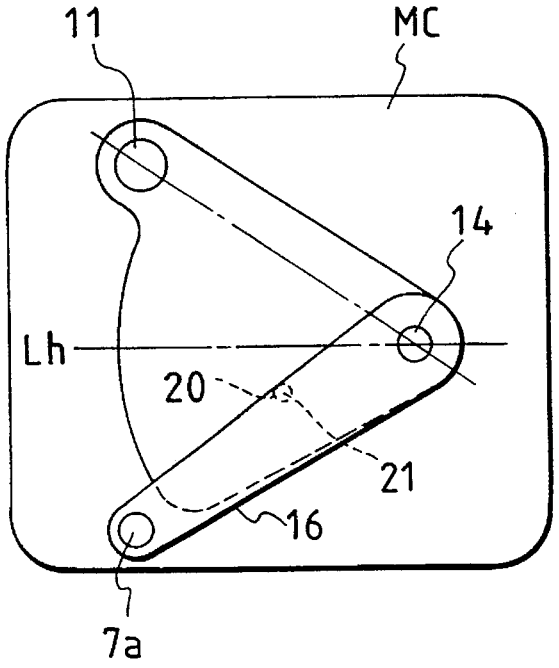
Figure 4A:
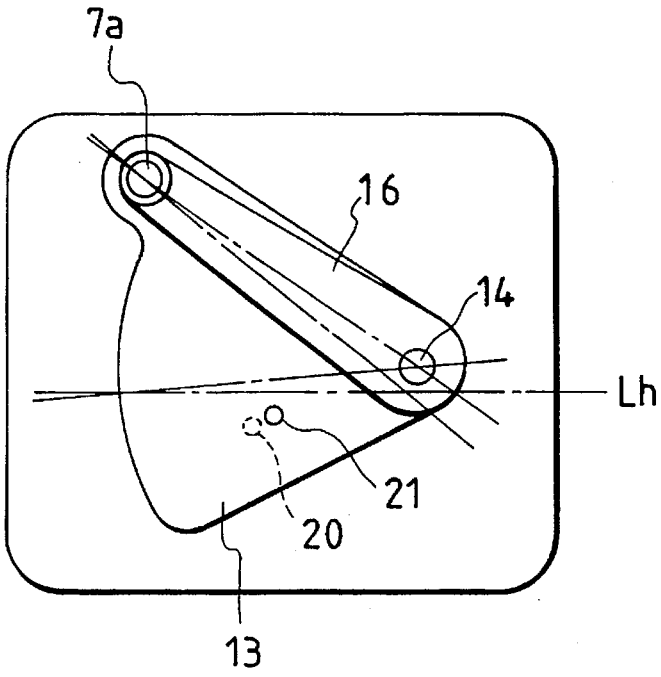
FIG. 4(*a*) is a diagram for an operation of the first embodiment showing the case where a regular pattern sewing mode and a basic line other than the middle basic line are set.
Figure 4B:
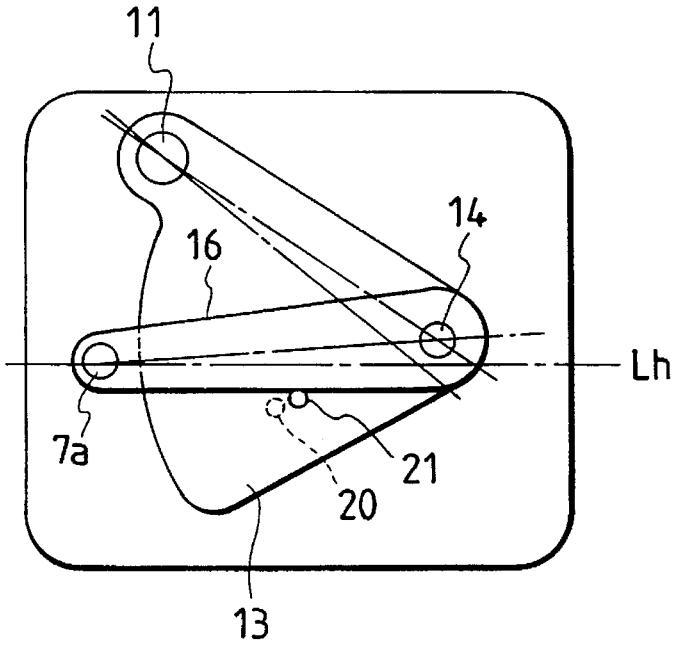

In addition, the embodiment is free from the difficulty that, in the case where the middle basic line and the reverse pattern sewing mode have been set as shown in FIG. 3(*b*), a basic line other than the middle basic line is set in error.

That is, in the case where the middle basic line and a reverse pattern have been set, the locking ball 22 is engaged with the engaging recess (fixed in position) 25, and one surface of the swing width adjusting arm 16 is confronted with the abutting pin 21 (see FIGS. 3(*b*) and 2(*c*)). Hence, even if it is tried to move the basic line changing board 13 to set a basic line other than the middle basic line, it is impossible to do so. That is, the protrusion of the abutting pin 21 is inhibited by the swing width adjusting arm 16, and the locking ball 22 is therefore held engaged with the engaging recess 25. Thus, the basic line changing board 13 cannot be moved.

As is apparent from the above-described, with the embodiment, the difficulty is eliminated that the inverse pattern sewing mode is set together with the right or left basic line, and accordingly the difficulty is also positively eliminated that the sewing needle N interferes with the throat plate NB, and the resultant seam is unsatisfactory. In other words, a multi-function zigzag sewing machine is greatly improved in safety effect according to the invention, thus being put in practical use.

In the above-described first embodiment, with the inverse pattern sewing mode set, the locking ball 22 serves as a locking member, and the abutting pin 21, the spring 23, and the swing width adjusting arm 16 serve as a locking member protruding mechanism. In the case where a basic line other than the middle basic line has been set, the abutting pin 21 serves as an abutting member, and the locking ball 22 and the mounting stand Mc serve as an abutting member protruding mechanism. Thus, in the first embodiment, the arm 16, the abutting pin 21, the locking ball 22, the spring 23, and the mounting stand Mc form pattern change inhibiting means, and basic line change inhibiting means.

Now, a second embodiment of the invention will be described.

Figure 5A:
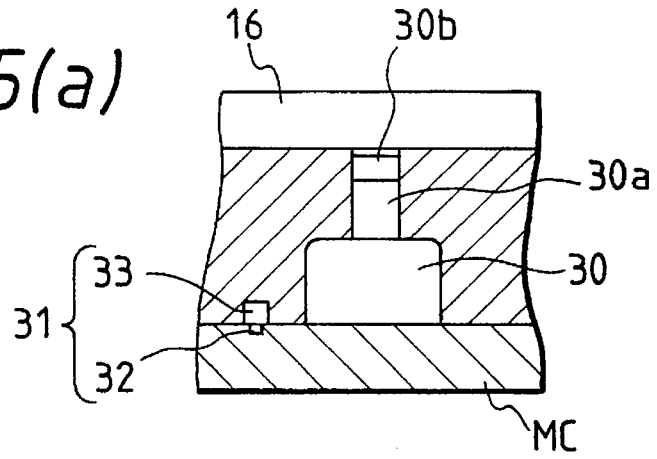
FIG. 5(*a*) is a sectional view showing parts of a second embodiment of the invention the case where the middle basic line is set.
Figure 5B:
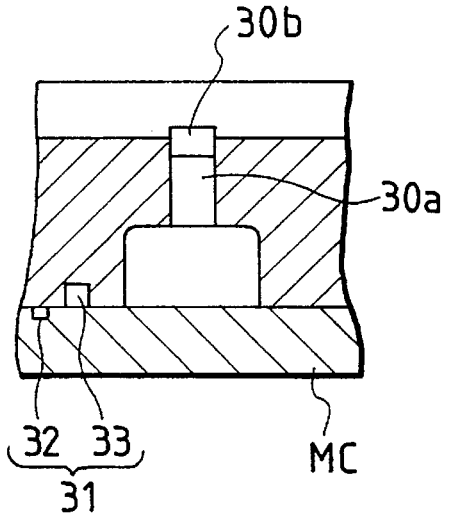
Figure 5C:
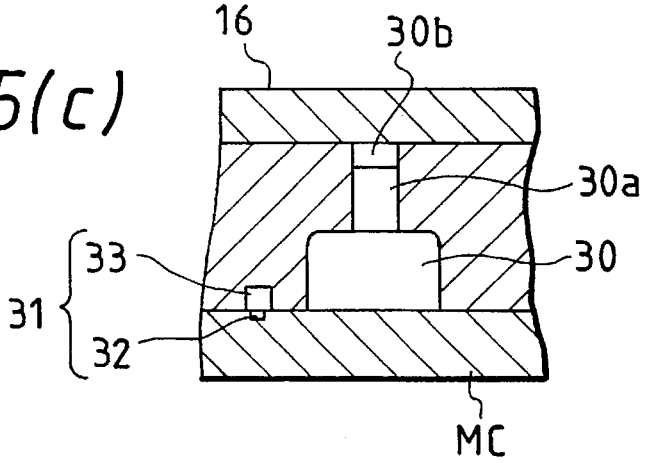
Figures 6A, 6B, 6C, 6D:
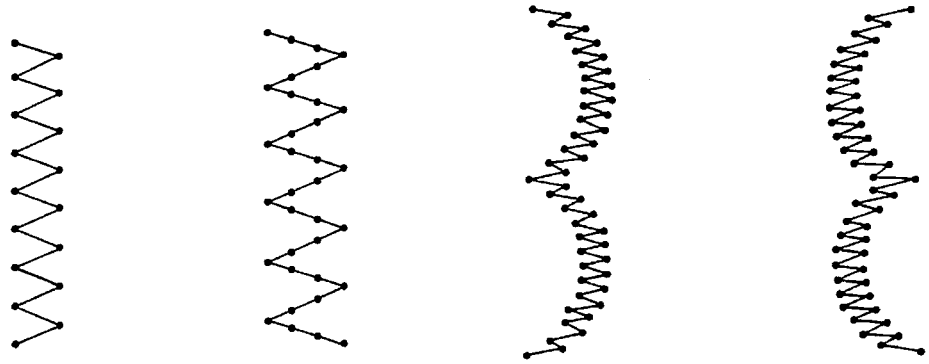
FIGS. 6(*a*) through 6(*d*) are plan views showing a variety of seams formed by a zigzag sewing machine.
Figures 7A, 7B, 7C:
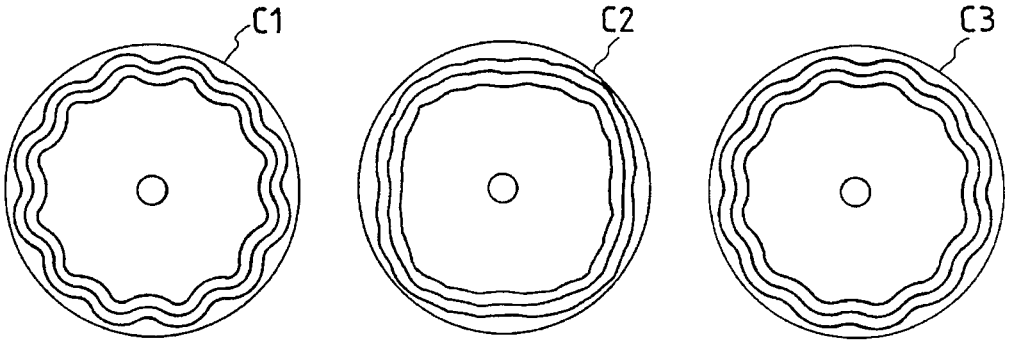
FIGS. 7(*a*) through 7(*c*) are plan views showing needle swinging cams for formation of the seams shown in FIGS. 6(*a*) to 6(*d*)
Figure 8:
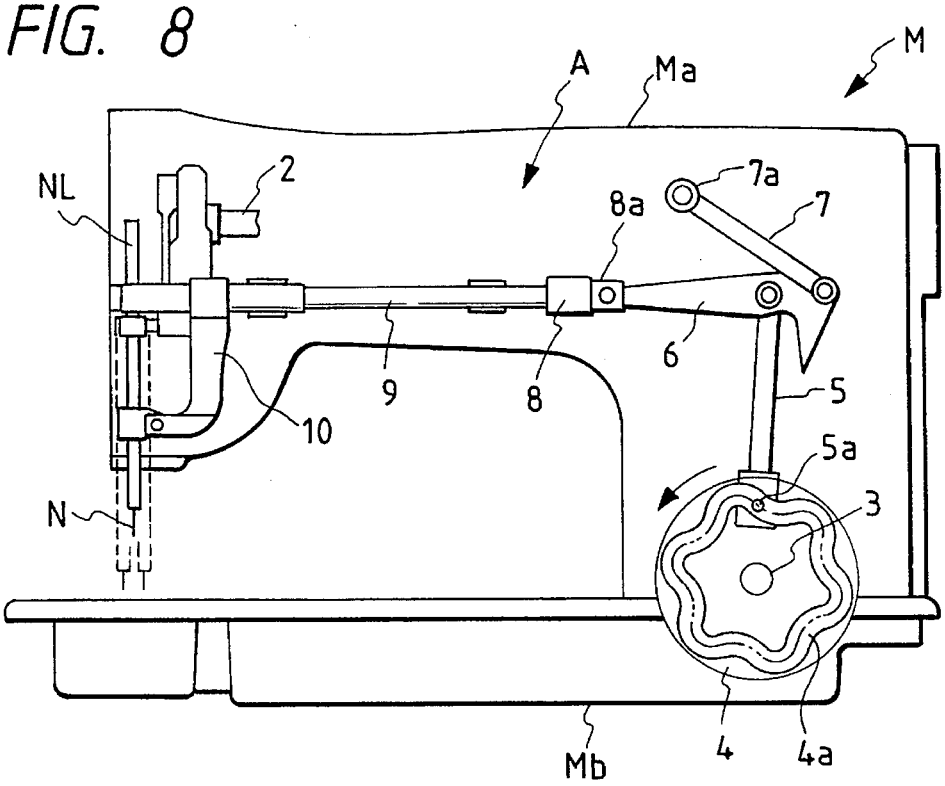
FIG. 8 is an explanatory side view outlining the arrangement of a conventional zigzag sewing machine.
Figure 9:
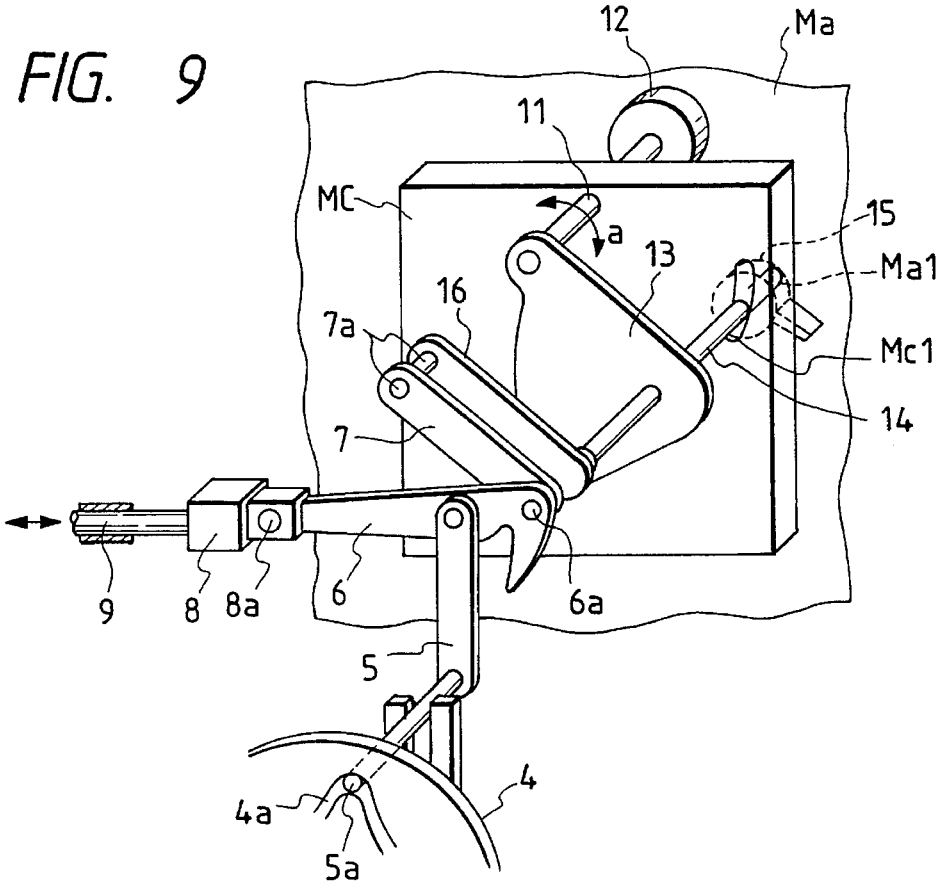
FIG. 9 is an explanatory perspective view outlining a basic line changing mechanism, a swing width adjusting mechanism, and a pattern selecting mechanism in the zigzag sewing machine shown in FIG. 8.
Figures 10A, 10B, 10C, 10D:
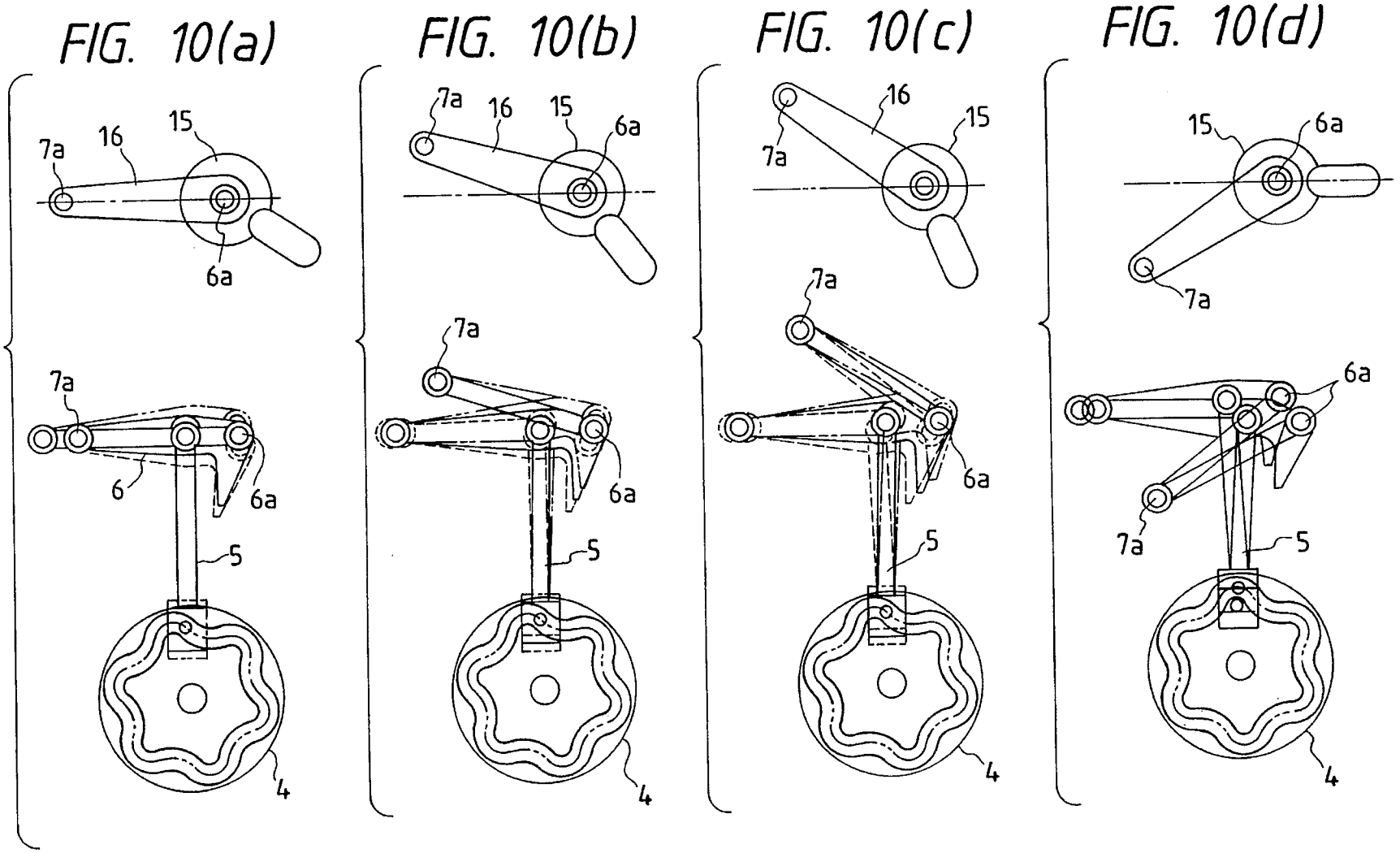
FIGS. 10(*a*) through 10(*d*) are explanatory side views for a description of a swing width adjusting operation by those mechanisms shown in FIG. 9.
Figure 13A:
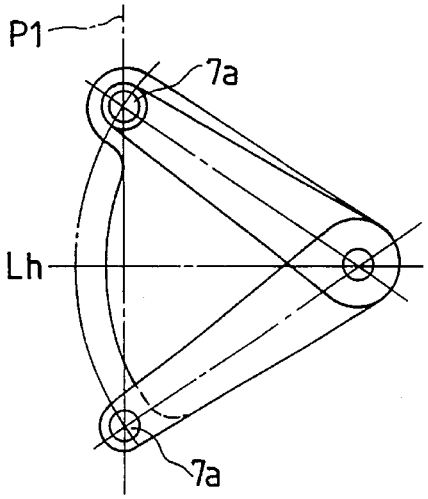
FIG. 13(*a*) is an explanatory side view showing the cases where, with respect to the mechanisms shown in FIG. 9, a regular pattern sewing mode and an inverse pattern sewing mode are set with the middle basic line selected.
Figure 13B:
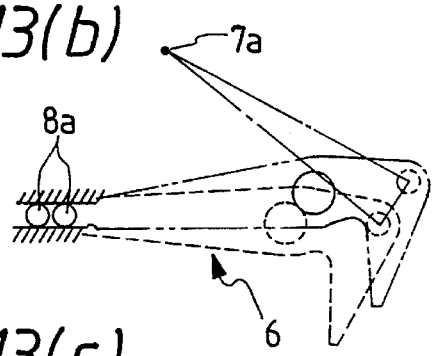
Figure 13C:
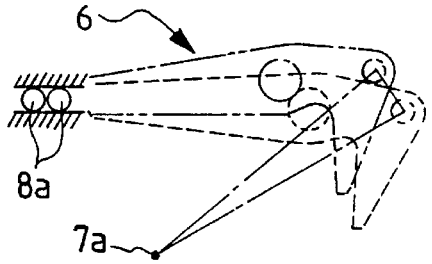
Figure 14A:
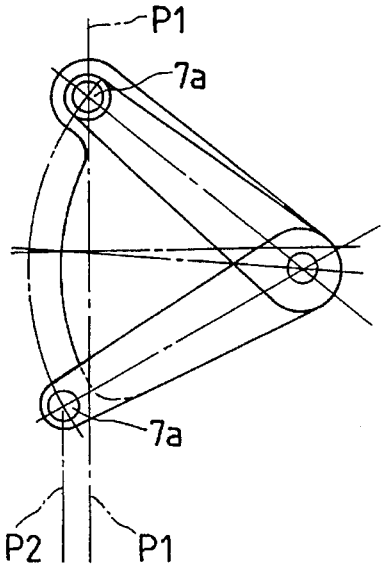
FIG. 14(*a*) is an explanatory side view showing the cases where, with respect to the mechanisms shown in FIG. 9, a regular pattern sewing mode and an inverse pattern sewing mode are set with the left basic line selected.
Figure 14B:
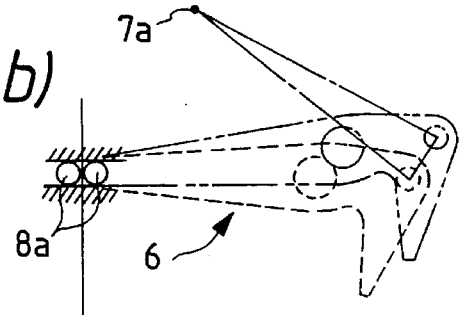
Figure 14C:
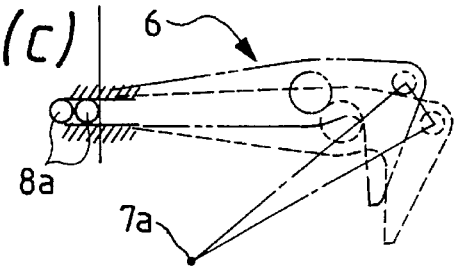
Figure 15B:
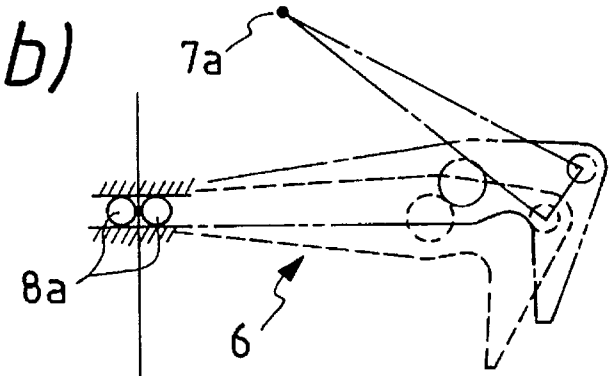
FIG. 15(*a*) is an explanatory side view showing the cases where, with respect to the mechanisms shown in FIG. 9, a regular pattern sewing mode and an inverse pattern sewing mode are set with the right basic line selected.
Figure 15C:
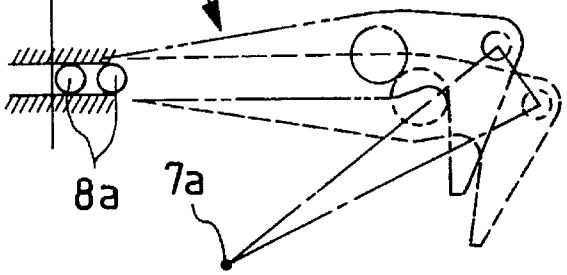
Figure 15A:
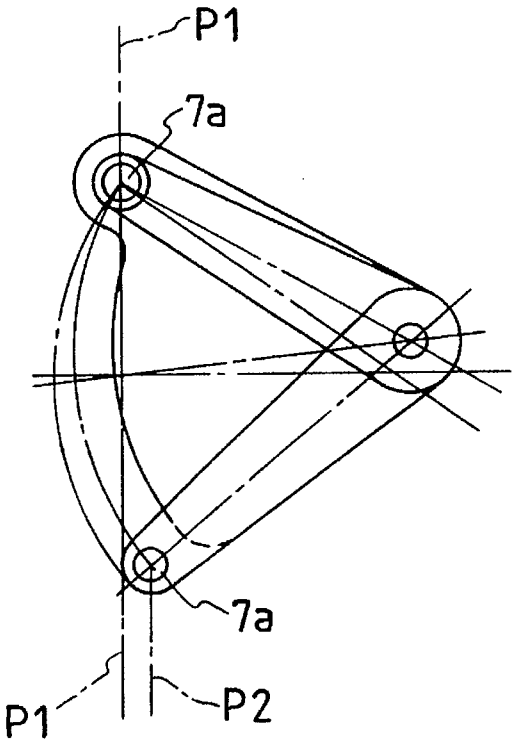
Figure 16:
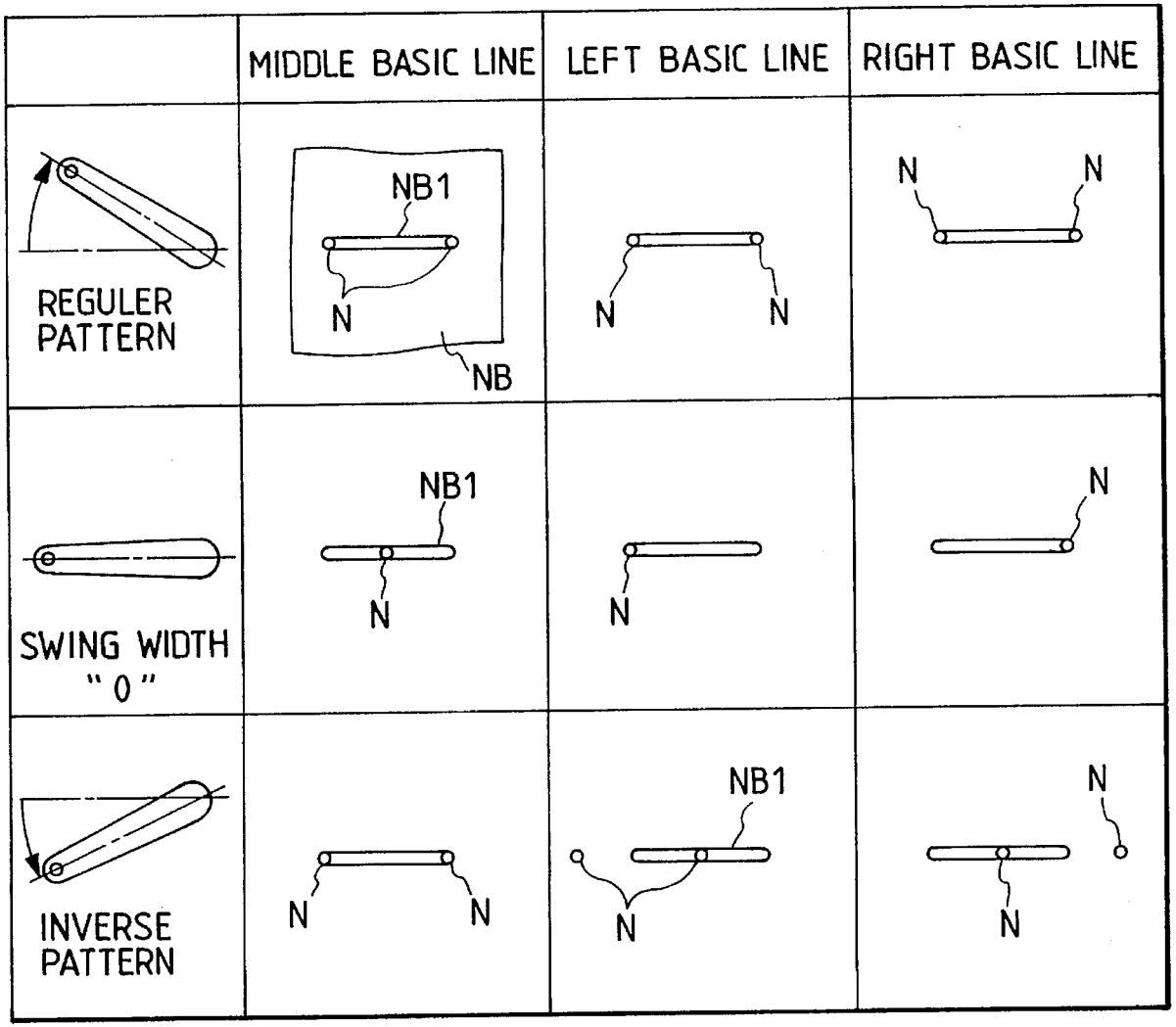
FIG. 16 is an explanatory diagram showing the swing positions of the sewing needle with different basic lines and different pattern sewing modes in the conventional zigzag sewing machine having the mechanisms as shown in FIG. 9.

The second embodiment is obtained by employing a mechanism as shown in FIG. 5 in place of the abutting pin 21, the spring 23, etc. in the first embodiment.

That is, in the second embodiment, a solenoid 30 is provided in the through-hole 20 of the basic line changing board 13, and detecting means 30 is provided to determine whether or not the middle basic line is selected. The solenoid 30 has a plunger 30*a* whose one end portion is protruded from the basic line changing board 13 when the solenoid is not excited. A high friction member 30*b* made of rubber or the like is fixedly mounted on the outer end face of the plunger 30*a*.

The detecting means 31 comprises: a magnetic substance 32 buried in the mounting stand Mc; and a magnetism sensing element 33 for sensing the magnetism of the magnetic substance 32. Under the condition that the middle basic line is selected, the magnetism sensing element 33 confronts with the magnetic substance 32, and the detecting means 31 outputs a detection signal. In response to the detection signal, the solenoid 30 is driven by a solenoid driving device (not shown), so that the plunger 30*a* is retracted into the through-hole 20 of the basic line changing board 13.

When, in the second embodiment thus designed, the middle basic line is selected, the plunger 30*a* is retracted into the basic line changing board 13 so that its one end portion is spaced from the basic line changing arm 16. Hence, the arm 16 can be freely swung, and therefore the swing width and the pattern can be freely set. If the basic line changing operation is carried out under the condition that a regular pattern sewing mode has been selected, then the detection signal of the magnetism sensing element 33 is cut off, and therefore the solenoid 30 is not driven, so that the plunger 30*a* is maintained protruded. The position where the plunger 30*a* protrudes in the above-described manner is so selected that, when the swing width is set to zero (0), the plunger 30*a* is brought into contact with or located near the end of the swing width adjusting arm 16. Hence, the movement of the swing width adjusting arm 16 into the reverse pattern region is prevented by the plunger 30*a* abutting against the arm 16.

Let us consider the case where it is tried to change the basic line to other than the middle basic line under the condition that an inverse pattern sewing mode has been set. If, in this case, the magnetism sensing element 33 together with the basic line changing board 13 is moved even slightly, the detection signal is cut off, so that the plunger 30*a* is protruded whereby the high friction member 30*b* is pushed against the one surface of the swing width adjusting arm 16 at a predetermined fixing position. As a result, the movement of the basic line changing board 13 is prevented, and the middle basic line is maintained set.

The second embodiment is also free from the difficulty that a basic line other than the middle basic line is set while the inverse pattern sewing mode is selected. Thus, the second embodiment may have the same effects as the above-described first embodiment.

In the second embodiment, the plunger 30*a* serves as an abutting member under the condition that a basic line other than the middle basic line is selected, and the body of the solenoid 30 acts as an abutting-member protruding mechanism. In addition, under the condition that the reverse pattern sewing mode is selected, the plunger 30*a* and the high friction member 30*b* act as a locking member, and the body of the solenoid 30 serves as a locking-member protruding mechanism. And, those components 16, 30, 30*a*, 30*b*, 31 and Mc form basic line change inhibiting means, and pattern change inhibiting means.

As was described above, the safety device according to the invention comprises: the pattern change inhibiting means for preventing the setting of the inverse pattern sewing mode when a basic patter other than the middle basic line has been selected; and the basic line change inhibiting means for inhibiting the setting of a basic line other than the middle basic line when the inverse pattern sewing mode has been set. Hence, the safety device completely inhibits the erroneous operations which may result in the interference of the sewing needle with the throat plate, or the formation of an unacceptable seam. This means that a zigzag sewing machine is greatly improved in safety. Accordingly, a multi-function zigzag sewing machine can be put in practical use which is heretofore difficult to realize. That is, the technical concept of the invention sufficiently meets the requirement in the apparel industry that a number of different items are manufactured each by only a small number.

What is claimed is:

1. In a zigzag sewing machine comprising:

a sewing needle;

a needle swinging mechanism for swinging said sewing needle right and left;

a swing width adjusting mechanism for adjusting the swing width of said sewing needle which is swung by said needle swinging mechanism;

a basic line setting mechanism for setting a middle basic line which is located at the middle of the swing width of said sewing needle, a right basic line located on the right side of said middle basic line, or a left basic line located on the left side of said middle basic line; and a pattern setting mechanism for selecting either a regular pattern sewing mode or an inverse pattern sewing mode, the improvement which comprises:

pattern change inhibiting means which, where a basic line other than said middle basic line has been set by said basic line setting mechanism, prevents a regular pattern sewing mode set by said pattern setting mechanism from being changed to an inverse pattern sewing mode; and basic line change inhibiting means which, where an inverse pattern sewing mode has been set by said pattern setting means, prevents said middle basic line set by said basic line setting mechanism from being changed to other than said middle basic line.

2. A zigzag sewing machine comprising:

a sewing needle;

a needle swinging mechanism for swinging said sewing needle right and left;

a swing width adjusting mechanism for adjusting the swing width of said sewing needle which is swung by said needle swinging mechanism;

a basic line setting mechanism for setting a middle basic line which is located at the middle of the swing width of said sewing needle, a right basic line located on the right side of said middle basic line, or a left basic line located on the left side of said middle basic line;

a pattern setting mechanism for selecting either a regular pattern sewing mode or an inverse pattern sewing mode; and a safety device including, pattern change inhibiting means which, where a basic line other than said middle basic line has been set by said basic line setting mechanism, prevents a regular pattern sewing mode set by said pattern setting mechanism from being changed to an inverse pattern sewing mode, and basic line change inhibiting means which, where an inverse pattern sewing mode has been set by said pattern setting means, prevents said middle basic line set by said basic line setting mechanism from being changed to other than said middle basic line.

3. A zigzag sewing machine according to claim 2, wherein said needle swinging mechanism comprises:

a needle swinging link whose one end portion is pivotably coupled to said needle bar;

a coupling shaft coupled to the other end portion of said needle swinging link;

a swing width changing link whose one end portion is pivotably coupled by said coupling shaft to the other end portion of said needle swinging link;

a swing fulcrum shaft which pivotably supports the other end portion of said swing width changing link; and a drive mechanism for swinging said swing width changing link through a predetermined swing angle about said swing fulcrum shaft, wherein said swing width adjusting mechanism comprises:

a swing width adjusting arm whose one end portion holds said swing fulcrum shaft; and a swing width adjusting shaft which is fixedly coupled to the other end portion of said swing width adjusting arm, and is swingably supported by a sewing machine frame, wherein adjustment of the swing width of said sewing needle is achieved by turning said swing width adjusting shaft in such a manner that said swing fulcrum shaft is shifted vertically, and switching a regular pattern sewing mode and an inverse pattern sewing mode over to each other is achieved by turning said swing width adjusting shaft in such a manner that said swing fulcrum shaft is moved between a regular pattern region and an inverse pattern region which are located respectively above and below a horizontal border line, and wherein said basic line setting mechanism comprises:

a basic line changing shaft which is rotatably supported by said sewing machine frame; and a basic line changing board which is fixedly mounted on said basic line changing shaft so as to be rotated together with said basic line changing shaft, and swingably supports said swing width adjusting shaft, wherein said basic line changing shaft is turned to move said swing width adjusting shaft to said border line, to set said middle basic line, and to move said swing width adjusting shaft above or below said border line, to set said left or right basic line.

4. A zigzag sewing machine comprising:

a sewing needle;

a needle bar coupled to said sewing needle;

a needle swinging mechanism for swinging said sewing needle right and left, said needle swinging mechanism including, a needle swinging link whose one end portion is pivotably coupled to said needle bar, a coupling shaft coupled to the other end portion of said needle swinging link, a swing width changing link whose one end portion is pivotably coupled by said coupling shaft to the other end portion of said needle swinging link, a swing fulcrum shaft which pivotably supports the other end portion of said swing width changing link, and a drive mechanism for swinging said swing width changing link through a predetermined swing angle about said swing fulcrum shaft;

a swing width adjusting mechanism for adjusting the swing width of said sewing needle which is swung by said needle swinging mechanism, said swing width adjusting mechanism including, a swing width adjusting arm whose one end portion holds said swing fulcrum shaft, and a swing width adjusting shaft which is fixedly coupled to the other end portion of said swing width adjusting arm, and is swingably supported by a sewing machine frame;

a pattern setting mechanism for selecting either a regular pattern sewing mode or an inverse pattern sewing mode, wherein adjustment of the swing width of said sewing needle is achieved by turning said swing width adjusting shaft in such a manner that said swing fulcrum shaft is shifted vertically, and wherein switching a regular pattern sewing mode and an inverse pattern sewing mode over to each other is achieved by turning said swing width adjusting shaft in such a manner that said swing fulcrum shaft is moved between a regular pattern region and an inverse pattern region which are located respectively above and below a horizontal border line;

a sewing machine frame;

a basic line setting mechanism for setting a middle basic line which is located at the middle of the swing width of said sewing needle, a right basic line located on the right side of said middle basic line, or a left basic line located on the left side of said middle basic line, said basic line setting mechanism including, a basic line changing shaft which is rotatably supported by said sewing machine frame, and a basic line changing board which is fixedly mounted on said basic line changing shaft so as to be rotated together with said basic line changing shaft, and swingably supports said swing width adjusting shaft, wherein said basic line changing shaft is turned to move said swing width adjusting shaft to said border line, to set said middle basic line, and to move said swing width adjusting shaft above or below said border line, to set said left or right basic line; and a safety device including, an abutting member disposed in said basic line changing board such that said swing adjusting arm is positioned on said abutting member when the inverse pattern is set, said abutting member having a top surface and a bottom surface, said abutting member being movable between a first position where said top surface of said abutting member is flush with said basic line changing board and a second position where said top surface of said abutting member protrudes from said basic line changing board to locus of said swing width adjusting arm, a spring urging said abutting member toward said mounting stand, a locking ball disposed in said basic line changing board, said locking ball being contact with said bottom surface of said abutting member, and an engaging recess disposed on said mounting stand, said engaging recess being receiving said locking ball when the middle basic line is set, wherein said abutting member is positioned the first position in the case where said locking ball is received in said engaging recess, and wherein said abutting member is positioned the second position in the case where said locking ball is not received in said engaging recess.

5. A zigzag sewing machine comprising:

a sewing needle;

a needle bar coupled to said sewing needle;

a needle swinging mechanism for swinging said sewing needle right and left, said needle swinging mechanism including, a needle swinging link whose one end portion is pivotably coupled to said needle bar, a coupling shaft coupled to the other end portion of said needle swinging link, a swing width changing link whose one end portion is pivotably coupled by said coupling shaft to the other end portion of said needle swinging link, a swing fulcrum shaft which pivotably supports the other end portion of said swing width changing link, and a drive mechanism for swinging said swing width changing link through a predetermined swing angle about said swing fulcrum shaft;

a swing width adjusting mechanism for adjusting the swing width of said sewing needle which is swung by said needle swinging mechanism, said swing width adjusting mechanism including, a swing width adjusting arm whose one end portion holds said swing fulcrum shaft, and a swing width adjusting shaft which is fixedly coupled to the other end portion of said swing width adjusting arm, and is swingably supported by a sewing machine frame;

a pattern setting mechanism for selecting either a regular pattern sewing mode or an inverse pattern sewing mode, wherein adjustment of the swing width of said sewing needle is achieved by turning said swing width adjusting shaft in such a manner that said swing fulcrum shaft is shifted vertically, and wherein switching a regular pattern sewing mode and an inverse pattern sewing mode over to each other is achieved by turning said swing width adjusting shaft in such a manner that said swing fulcrum shaft is moved between a regular pattern region and an inverse pattern region which are located respectively above and below a horizontal border line;

a sewing machine frame;

a basic line setting mechanism for setting a middle basic line which is located at the middle of the swing width of said sewing needle, a right basic line located on the right side of said middle basic line, or a left basic line located on the left side of said middle basic line, said basic line setting mechanism including, a basic line changing shaft which is rotatably supported by said sewing machine frame, and a basic line changing board which is fixedly mounted on said basic line changing shaft so as to be rotated together with said basic line changing shaft, and swingably supports said swing width adjusting shaft, wherein said basic line changing shaft is turned to move said swing width adjusting shaft to said border line, to set said middle basic line, and to move said swing width adjusting shaft above or below said border line, to set said left or right basic line; and a safety device including, detecting means for detecting whether or not said middle basic line is set, a solenoid disposed in said basic line changing board, a plunger disposed in said basic line changing board, one end of said plunger being connected to said solenoid, a high frictional member disposed onto the other end of said plunger, wherein said high frictional member is protruded from said basic line changing board to a locus of said swing width adjusting arm by said solenoid when said detecting means detects said middle basic line is not set, and wherein said high frictional member is pull down by said solenoid when said detecting means detects said middle basic line is set.

* * * * *

UNITED STATES PATENT AND TRADEMARK OFFICE

CERTIFICATE OF CORRECTION

PATENT NO. : 5,601,042
DATED : February 11, 1997
INVENTOR(S) : Seji GOTO

It is certified that error appears in the above-indentified patent and that said Letters Patent is hereby corrected as shown below:

Column 13, line 32, "contact" should be --contacted--.

Column 13, line 35, "being" should be deleted.

Column 14, line 58, "pull" should be --pulled--.

Signed and Sealed this

Twenty-first Day of April, 1998

Bruce Lehman

*Attest:*

BRUCE LEHMAN

*Attesting Officer*

*Commissioner of Patents and Trademarks*